US005799824A

United States Patent [19]

Gasiel

[11] Patent Number: 5,799,824

[45] Date of Patent: Sep. 1, 1998

[54] APPARATUS AND METHOD TO DETER BREAKAGE OR DEFORMATION OF VERTICALLY STACKED CONTAINERS DURING DISPENSION FROM A VENDING MACHINE

[75] Inventor: Joseph F. Gasiel, West Des Moines, Iowa

[73] Assignee: Fawn Engineering Corporation, Des Moines, Iowa

[21] Appl. No.: 790,299

[22] Filed: Jan. 31, 1997

[51] Int. Cl.[6] ..... G07F 11/00

[52] U.S. Cl. ..... 221/298; 221/289; 221/116; 221/112

[58] Field of Search ..... 221/298, 289, 221/116, 112

[56] References Cited

U.S. PATENT DOCUMENTS

| | | | |
|---|---|---|---|
| 1,367,081 | 2/1921 | Olson | 198/463 |
| 1,503,585 | 8/1924 | Headley et al. | 221/242 |
| 2,785,828 | 3/1957 | Patzer | 221/129 |
| 3,055,548 | 9/1962 | Allegri | 221/97 |
| 3,125,246 | 3/1964 | Barnhart | 221/129 |
| 3,753,514 | 8/1973 | Naguet | 221/129 |
| 4,120,393 | 10/1978 | Motooka et al. | 198/460 |
| 4,164,279 | 8/1979 | Dubuit | 198/492 |
| 4,405,059 | 9/1983 | Kull | 221/116 |
| 4,542,834 | 9/1985 | Kurosawa et al. | 221/116 |
| 4,676,398 | 6/1987 | Kokubun et al. | 221/129 |
| 4,757,915 | 7/1988 | Albright et al. | 221/75 |

*Primary Examiner*—William E. Terrell
*Assistant Examiner*—Khoi H. Tran
*Attorney, Agent, or Firm*—Zarley, McKee, Thomte, Voorhees, & Sease

[57] ABSTRACT

An apparatus and method of deterring or reducing breakage or deformation when dispensing a vertical stack of containers. A blocking member used to restrict dispension of vertical stack containers above a container being dispensed, can have a biasing member associated with it to allow it to vertically move to cause the stack to drop in a controlled fashion so that the block is not forced into the side walls of the containers, and so the dropping of the containers is controlled in a manner to reduce or deter the likelihood of breakage or deformation of the containers. An alternative feature of the invention is the use of a biasing member to return the blocking member to an original member to an original position once the weight of any vertical stack above it is removed.

17 Claims, 5 Drawing Sheets

10
12
14A
14B
14C
14D
14E
16

14
12
32
34
36
28
26
38
40
42
44
46
50
52
20
30
22
24
60
54
56
58

84
88
82
76
80
22
86
18B
38
70
26
20
64
24
60
62
56
18A
20
14B
34
66
50
38
18B
20
24
56
48
36
26
46
58
24
60
12
14A
18A
44
32
30

APPARATUS AND METHOD TO DETER BREAKAGE OR DEFORMATION OF VERTICALLY STACKED CONTAINERS DURING DISPENSION FROM A VENDING MACHINE

BACKGROUND OF THE INVENTION

A. Field of the Invention

This invention relates to vending machines, and in particular, to vending of vertically stacked containers by gravity.

B. Problems in the Art

The use of gravity to dispense containers in vending machines has certain advantages. It allows the force of gravity to be used as a motive force, thereby reducing the amount of needed equipment. Vertical stacking of containers can also be more convenient with regard to loading the vending machine with containers.

There are a number of different types of vertically dispensing vending machines. An example can be found in co-pending, co-owed U.S. patent application Ser. No. 08/538,569, to inventors, Francis A. Wittern, Jr., Paul L. Hawkins, James L. Denato (and Francis A. Wittern, III).

As is typical of vertical dispensing machines utilizing gravity, release or dispension of the bottom-most container in the stack requires the remainder of the stack to drop so that the next-to-bottom container assumes the bottom-most container position, and is then ready to be dispensed. While the use of gravity as a motive force to move the stack during dispension is beneficial, difficulties arise with regard to the possibility of breakage or deformation of one or more of the containers in the stack. This is especially true when the stack is substantially tall and/or when the containers are made of relatively fragile material such as glass or thin wall plastic.

For example, in the above identified application, a dispensing control mechanism is used whereby the bottom-most container is blocked from being allowed to drop vertically out of the stack for dispension until it is authorized to do so. That lower block is than moved out of the way of the stack. To prevent the next-to-bottom-most container from being dispensed, a separator finger moves to block the remainder of the stack when the bottom-most container is authorized to be dispensed. Once the bottom-most container is dispensed and cleared from the stack, the separator finger moves out of the stack and the remainder of the stack drops so that the next-to-bottom-most container now becomes the bottom-most container. Prior to that drop, the lower block is repositioned in line with the stack to prevent any containers from being dispensed.

The above described dispensing control requires a separator finger to be spaced roughly the width of a container away from the lower block. As can be understood, once the bottom-most container is dispensed and the separating finger is removed from holding the remainder of the stack back, the entire stack drops roughly the width of a container.

In situations where the stack is ten, fifteen, twenty, or more containers high, and the containers are filled with liquid, such as carbonated beverages, the drop of an entire stack can generate enough forces to either deform the side walls of one or more containers, or even break the side walls, especially if they are glass.

Although certain things can be done with the lower block and separator finger to try to minimize the shock or force of this drop, there is a need in the art for an improvement in the ability to reduce or deter breakage or deformity, or other problems, that can be associated with the drop.

For example, another problem may be that the force or shock of the drop is sufficient to misalign or wedge one or more containers in the stack relative to whatever holding device or column the stack is placed in. This could cause problems with jamming or other malfunction of the process of dispensing. This is especially true with bottles which do not have a uniform cross section from top to bottom, and which are stacked on their side.

It is therefore a principal object of the present invention to provide an apparatus and method for reducing or deterring breakage or deformation of vertically stacked containers in the dispensing system that overcomes the problems and deficiencies in the art.

Other objects of the present invention include the provision of such an apparatus and method which:

a. Allows the advantages of use of gravity as a mode of force in the dispensing process.

b. Reduces the risk of breakage or deformity by reducing the nature of the drop of the vertical stack once a bottom-most container is dispensed.

c. Reduces the risk of breakage or deformity by reducing the shock associated with the drop of the stack.

d. Reduces the risk of breakage or deformity by acting against the force of the stack when it attempts to drop.

e. Reduces any unbiased drop distance.

f. Is non-complex, economical and durable.

g. Is flexible and adjustable.

These and objects, features, and advantages of the present invention will become more apparent with reference to the accompanying specification and claims.

SUMMARY OF THE INVENTION

The invention relates to an apparatus and method of reducing or deterring breakage or deformity of vertically stacked items during dispension from a vending machine. According to one aspect of the invention, an apparatus includes a vertical column for holding the vertical stack, a dispensing controller at the lower end of the vertical column, an actuator which controls the dispensing controller, a separator member connected to the actuator, and a biasing member connected to the separator. The separator blocks any remainder of the vertical stack from moving downwardly when the bottom-most container is dispensed. The biasing member exerts biasing force against the weight of the stack but allows these separator to move downwardly in a controlled manner. This deters a quick or sudden drop for part of the distance to the bottom of the vertical stack to deter breakage or deformation of any of the remaining containers in the stack. Once the separator is removed from the stack, the remainder of the stack drops to the bottom of the column so that the next-to-bottom-most container is now ready to be dispensed. Because the separator is moved part of the distance towards the bottom of the column, the remaining drop to the bottom of the column is reduced, which also reduces the potential of breakage or deformity of any containers.

In another aspect of the invention, a method of reducing or deterring breakage blocks the bottom-most container of the vertical stack from moving downward and being dispensed. Prior to release of the bottom-most container for dispension, the next-to-bottom-most container is blocked from being dispensed and is allowed to move downward. A biasing force is applied against the vertical stack while the stack is moving downward to control its movement. The remainder of the distance to the bottom of the column for dispension is then reduced over against allowing the stack to drop a distance approximately the entire width of a container.

DETAILED DESCRIPTION OF THE PREFERRED EMBODIMENT

Figures 1, 2:
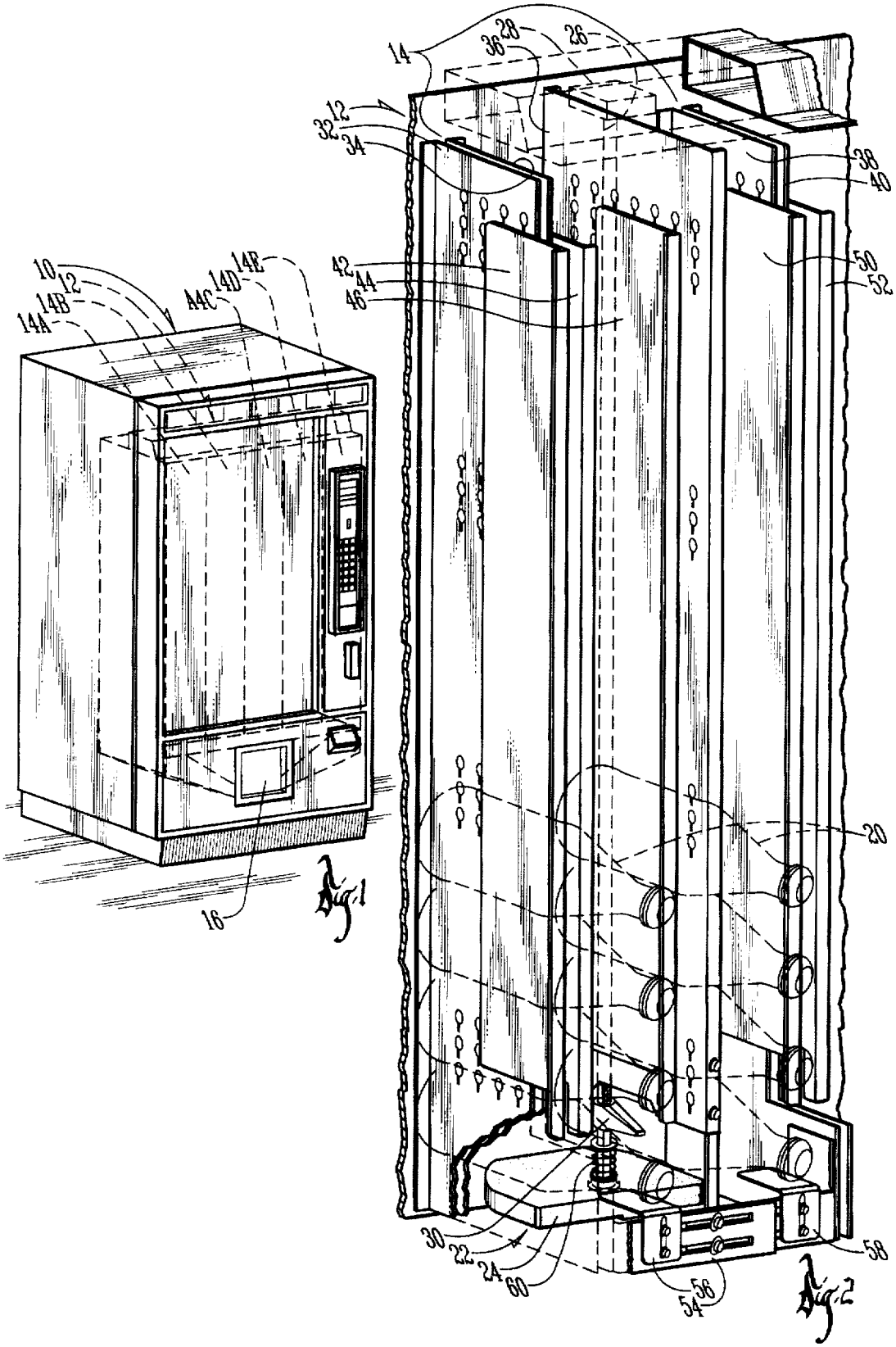
FIG. 1 is a perspective view of a vending machine showing an interior dispensing system that utilizes vertical stacks in vertical columns that take advantage of gravity to dispense items and move the remaining items in the stacks downwardly to a dispensing position.
FIG. 2 is an enlarged fragmented perspective view of two vertical columns that could be used in the vending machine of FIG. 1, and a dispensing controller at the bottom of the columns which controls dispension of containers.

To assist in a better understanding of the invention, one embodiment which the invention can take will now be described in detail. In this description, frequent reference will be made to the drawings. Reference numbers will be used to indicate certain parts and locations in the drawings. The same references numerals will be used to indicate the same parts and locations throughout all of the drawings, unless otherwise indicated.

FIG. 1 depicts a vending machine 10 such as are well known in the art. A vertical stack dispensing system 12 is shown inside machine 10 by dashed lines. Vertical stack dispensing system 12 is shown with five vertical trays 14A, 14B, 14C, 14D, and 14E. Each is identical and each has a lower end from which vertically stacked containers are dispensed to a common dispensing outlet 16. By referring to co-pending Ser. No. 08/538,569, the structure and operation of one example of such a vertical stacked dispensing system 12 can be seen, and the details of such a system are incorporated by reference herein. Ser. No. 08/538,569 also discloses a dispensing controller which controls the release of the bottom-most containers in the stack, one by one, such as are authorized by the vending machine control system.

FIG. 2 illustrates in detail a vertical tray 14A (all trays 14A–E are the same). In this embodiment it is to be understood that each tray 14A–E has two vertical side by side columns 18A and 18B, each holding a vertical stack of containers 20 one on top of each other in single file. The dispensing controller consists of a cam 24 at the bottom of columns 18A and 18B. An actuator rod 26 extends from a motor 28 at the top of columns 18A and 18B and between columns 18A and 18B to cam 24. The actuator rod 26, by operation of motor 28, rotates around an axis defined by actuator rod 26. As is discussed in detail in Ser. No. 08/538,569, cam 24 is essentially shaped around the axis of rod 26 and by rotation can alternatively open a release path for the bottom-most container 20 of column 18A or the bottom-most container 20 of column 18B.

Additionally, the dispensing controller includes a separator finger 30 that is spaced upwardly apart from cam 24 along actuator rod 26. Separator finger 30 basically extends in a direction opposite that of cam 24 relative to actuator rod 26. Therefore, when cam 24 is rotated to open or unblock the bottom of column 18A, separator finger 30 rotates into column 18A and serves to block any containers above separator finger 30 from being dispensed. Similarly, if cam 24 unblocks columns 18B, separator finger would block containers above it in column 18A from being dispensed.

As further discussed in Ser. No. 08/538,569, a series of walls defines columns 18A and 18B. In FIG. 2 it can be seen that wall pair 32 and 34, along with adjustable wall edges 42 and 44 define the left side of column 18A, whereas center wall 36 and adjustable wall piece 46 define the right side of column 18A. The center wall 36 and adjustable wall piece 48 (not shown FIG. 2), along with wall join??? 38 and 40 and adjustable wall edges 48 and 50 define the left and right sides of column 18B. Pieces 42, 44, 46, 48, and 50 are adjustable vertically and horizontally for different sized containers.

Additionally, the bottom of columns 18A and 18B have a front edge 54 that is adjustable horizontally. Vertically adjustable blocking members 56 and 58 are attached to front edge 54 which serve to cause the bottom-most containers 20, to release from columns 18A and 18B by their back ends dropping first, followed by the front ends.

Figure 3:
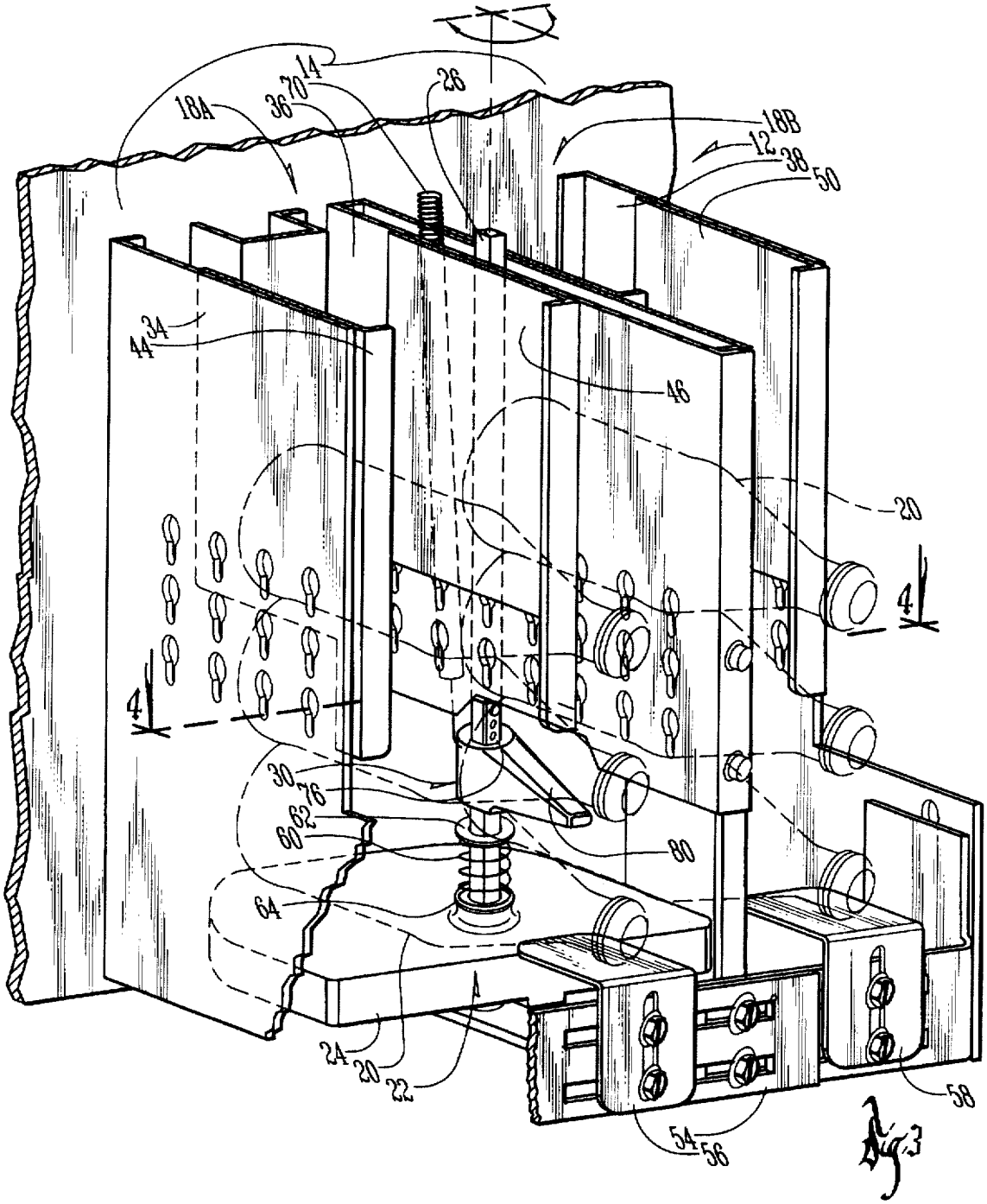
FIG. 3 is a still further enlarged fragmentary perspective view of the dispensing controller of FIG. 2.
Figure 5:
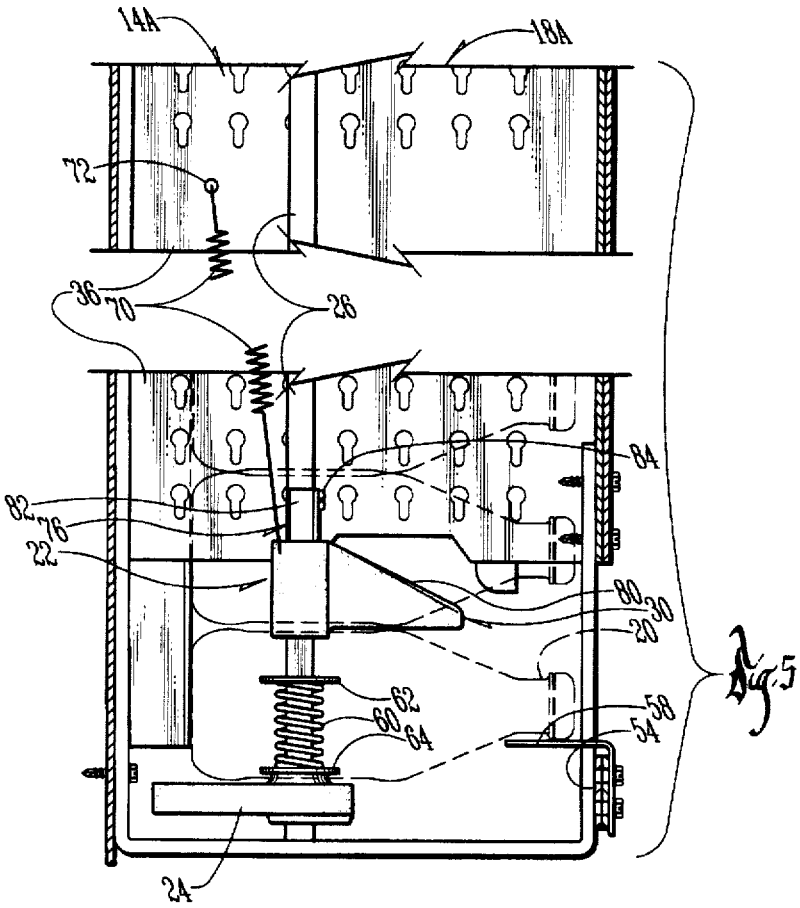
FIG. 5 is a sectional view taken along line 5—5 of FIG. 4.

FIG. 3 shows in detail that a spring 60, placed between washer 62 and 64 is positioned around rod 26 between cam 24 and separator finger 30. Additionally a spring 70 is connected between separator finger 30 and an attachment connected between separator finger 30 and an attachment aperture 72 above separator finger on center wall 36 (see FIG. 5). Separator finger 30 has a center channel 74 that is shaped so that it allows separator finger 30 to slide along rod 26. An adjustable stop member 76 is secured to rod 26 and serves to limit the upward movement of finger 30 along rod 26. Spring 70, being in tension, biases finger 30 to the upper stop 76 when in a normal position. If sufficient force is exerted on top of finger 30 to overcome the upward biasing force of spring 70, finger 30 can move downwardly on rod 26. When it abuts washer 62, if sufficient force is exerted on top of finger 30 to overcome the upward biasing force of spring 70 and the resisting force of spring 60 as it is compressed, finger 30 can continue to move downwardly along rod 26.

Figure 4:
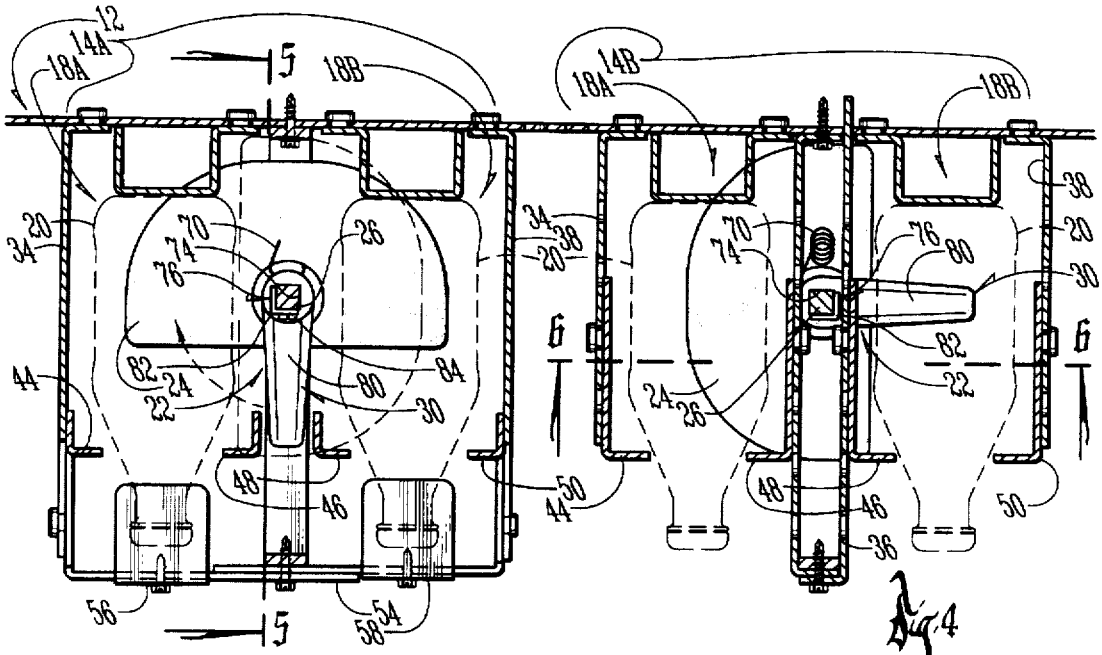
FIG. 4 is top sectional view taken along line 4—4 of FIG. 3.

FIG. 4 illustrates the operation and relationship of cam 24 and separator finger 30. On the left side of FIG. 4 in tray 14A, cam 24 and separator finger 30 are in a normal, non-dispensing state. Cam 24 blocks release of the lower-most container 20 in either column 18A or 18B of tray 14A. Finger 30 is positioned outside of either column 18A or 18B of tray 14A. Both vertical stacks of containers 20 are therefore blocked and supported by cam 24, with the help of blocks 56 and 58. By referring also to FIG. 5, it can be seen that finger 30 is spaced apart from cam 24 approximately the width of container 20 and rotates to separate the bottom-most container 20 from the next-to-bottom-most container 20 and thus is above the bottom-most container (which is to be dispensed) but below the next-to-bottom-most container and thus below the remainder of the vertical stack.

Tray 14B of FIG. 4 illustrates the position of cam 26 and finger 30 when the lower-most container 20 of the right hand side of column 18B is to be dispensed. Cam 24 is rotated counter clockwise from its normal blocking position and its eccentric shape is completely removed from the path of column 18B. Thus, the block and support underneath the bottom-most container 20 of column 18B is removed.

Blocks 56 and 58 are not shown under tray 14B. Finger 30 therefore serves to block the remaining containers 20 of the vertical stack from being dispensed (See FIG. 6). The removal of cam 24 from the path of the right side of tray 14B allows the bottom-most container 20 to drop vertically down by gravity and be dispensed. Note that cam 24 at all times blocks the bottom-most container and whole column of column 18A from being dispensed while the bottom-most container of column 18B of tray 14B is being dispensed.

After the bottom-most container of column 18B of tray 14B has been dispensed, cam 24 and finger 30 are rotated clockwise back to the position shown at tray 14A of FIG. 4 and the removal of finger 30 allows the entire stack to drop down so that the next-to-bottom-most container is now the bottom-most container.

Figure 6:
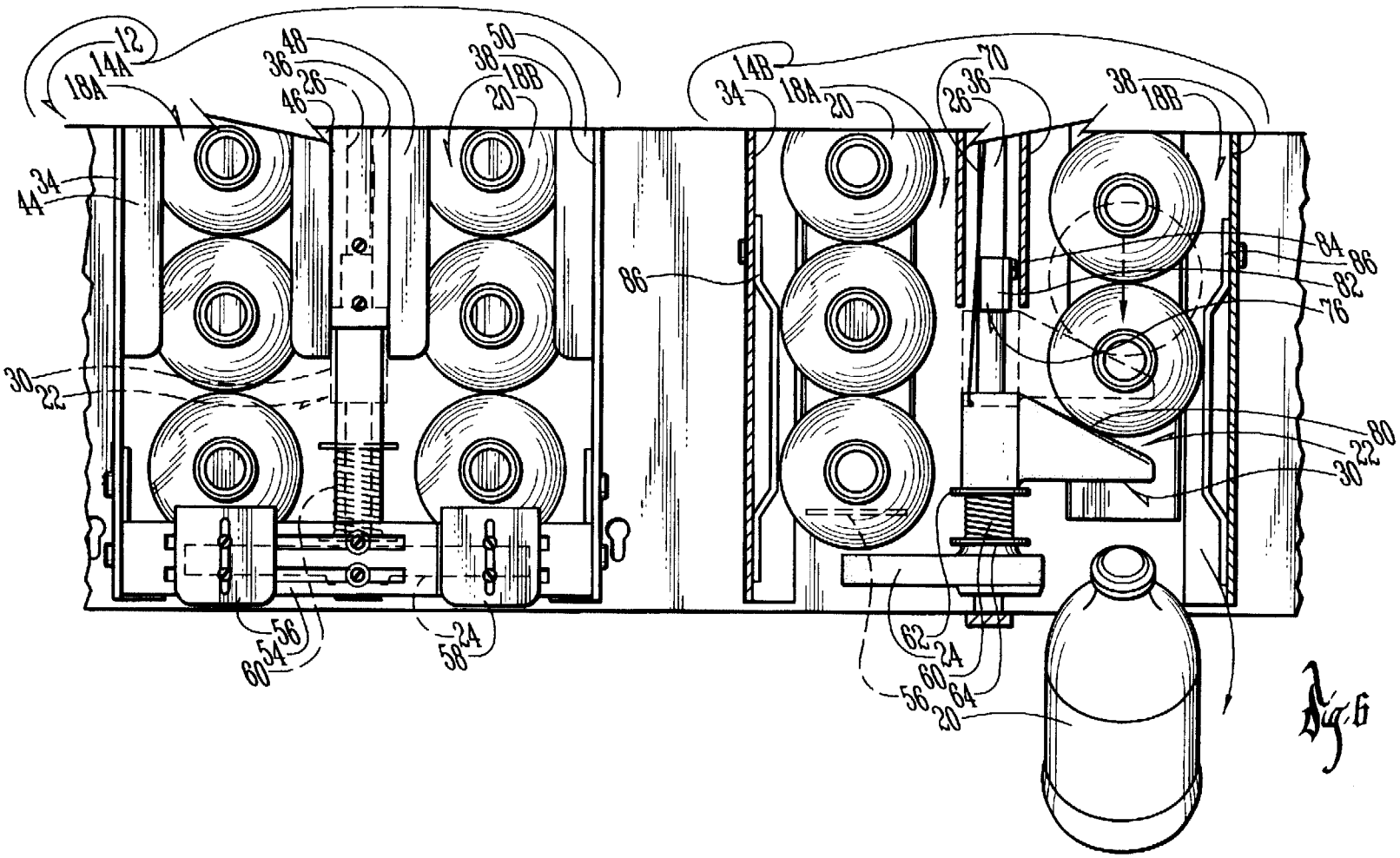
FIG. 6 is a sectional view taken along line 6—6 of FIG. 4.

As previously described, this dropping (upon removal of finger 30) results in any remaining containers 20 vertically above the container that was dispensed to drop the equivalent of the width of a container. Although certain measures can be taken to attempt to minimize the forces or shock that any of the containers in the vertical stack experience upon this drop, blocks 56 and 58 are fairly rigid, and the surface of cam 24 cannot be too cushioning for friction reasons. Therefore, by referring to FIG. 6 and 7, it can be seen that finger 30, in combination with spring 60 and 70, serve to reduce the forces or shock that would otherwise be experienced by this drop. FIG. 6, the left side of the drawing (tray 14A), shows columns 18A and 18B with cam 24 and finger 30 in the normal position shown in the left side of FIG. 4. Both vertical stacks of containers 20 are supported and blocked by cam 24. Finger 30 is raised to its uppermost positioned by spring 70, and spring 60 is uncompressed. When bottle 20 at the right side of FIG. 6 (at tray 14B) is to be dispensed, cam 24 turns out of the path of column 19B and at the same time, finger 30 enters the space be Seen the bottom-most container 20 and the next-to-bottom-most container 20. As rotation of cam 24 and 30 continues, the sloped surface 80 of the top side of finger 30, if there are any containers 20 above finger 30, causes finger 30 to move downwardly along shaft 26 because the weight of most containers 20 would overcome the upward force pulling on finger 30 of spring 70. When cam 26 is completely out of the path of column 18B of tray 14B, the bottom-most container 20 is free to drop and if there is sufficient weight above finger 30, the vertical stack will continue to overcome the force of spring 70 and may serve to overcome the upward force of the spring 60 as it compresses. There will come a point where either force of spring 70 and 60 stops the downward movement of finger 30 on rod 26, or the force of containers 20 will move finger 30 to the point where spring 60 is completely compressed and serves as a mechanical downward limit.

In any event, the operation of finger 30 and springs 60 and 70 serve to gently lower the vertical stack above finger 30 from the upper normal position of finger 30 to where it abuts spring 60, and to again gently lower the vertical stack until spring 60 is completely compressed, if the vertical stack has sufficient weight to do so. Any lowering of finger 30 therefore reduces the distance between the next-to-bottom-most container and cam 24 so that when finger 30 is removed from below the next-to-bottom-most container (see the right side of FIG. 7), its sloped surface 80, and its reduced distance to cam 24 will substantially shorten the distance that next-to-bottom-most container 20 and the remainder of the stack has to travel down to cam 24, which by the time finger 30 is rotated out of the path of the containers, and cam 24 will completely block the bottom of the column (see dashed lines on the right side of FIG. 7).

When finger 30 is completely out of abutment with a container 20, spring 70 will pull it up and spring 60 will push it up rod 26 until spring 60 is fully extended (out of compression). Spring 70 will assist in that, and once spring 60 is fully extended, spring 70 will pull finger 30 all the way up to stop 76 so that it is in position to move in-between and separate the next containers 20 in either column 18A or 18B, depending on which way finger 30 is next rotated.

In the preferred embodiment the biasing of finger 30, either resisting the downward weight of a stack of containers, or pulling it up to its upper stop, are accomplished with spring 60 and 70. Other alternative ways of biasing could be utilized as are within the skill of those skilled in the art. Additionally, the biasing system could be utilized with a single vertical column dispensing system.

It will be appreciated that the preferred embodiment is given by way of example only and not by way of limitation to the invention which is solely described by the claims herein. Variations obvious to one skilled in the art will be included within the invention defined by the claims.

Figure 7:
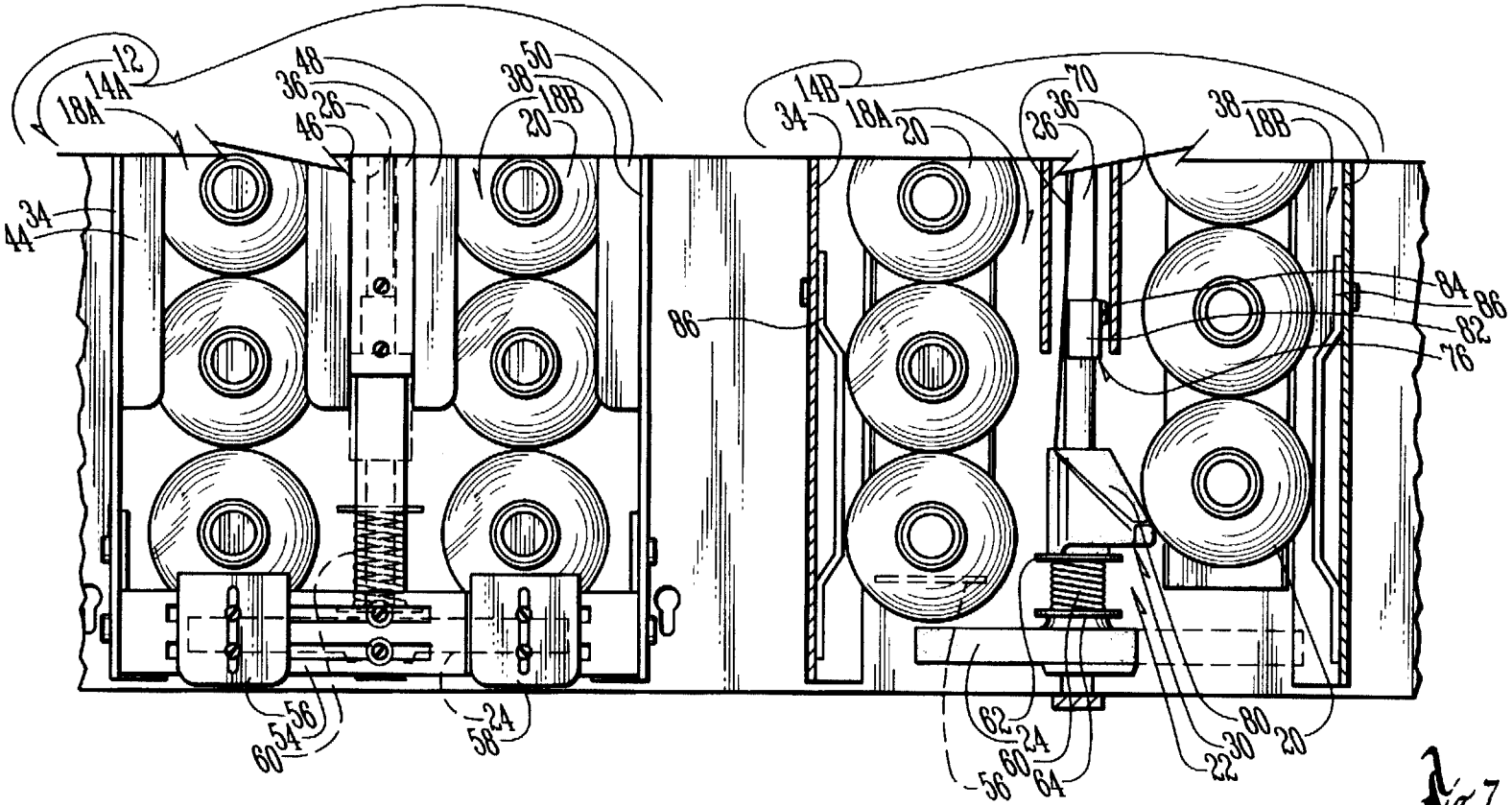
FIG. 7 is a fragmentary elevational and sectional view similar to FIG. 6 but showing a different stage of dispension of the vertically stacked containers.

By referring again to FIGS. 4 and 5, adjustment stop member 76 consists of an L shaped member 82 that can be fitted around two sides of rod 26 and secured along rod 26 by a screw 84 that extends through an aperture in L-shaped member 82 and into one of a plurality of apertures (not shown) along rod 26 vertically. This upper stop can then be adjusted for different widths of containers 26. In FIG. 7, spacer members 86 can be placed along the outer wall of the column if needed to keep the bottom-most and next-to-bottom-most containers closer to rod 26, so that finger 30 can operate more effectively on those containers.

The shape of finger 30 assists in the controlled dropping of the stack above the finger. The space between the bottom of finger 30 and the top of spring 60 (see FIG. 5) when the finger is in the normal upper position, pulled up by spring 70, allows finger 30 to have some leeway to hunt for a space between containers 20. In other words, some margin of error to line up to enter between successive containers 20 can be tolerated. Finger 30 can float a little bit to find a most favorable position to separate those containers 20. This assists in reducing the risk of damaging or deforming the sidewalls of containers 20.

What is claimed is:

1. An apparatus to facilitate dispensing of containers in a vertical stack comprising:

a dispensing device including a holder that defines a vertical stack column and can receive and retain a plurality of containers in a vertical stack, the vertical stack column including a lower end;

a dispensing controller at or near the lower end of the vertical stack column, the dispensing controller including a blocking member which can support a vertical stack and which can block release of a container at the lower end of the vertical stack column until dispension is authorized;

an actuator mounted in the dispensing device for moving said blocking member;

a separator member connected to the actuator and moveable between a first horizontal position outside of the vertical stack column and a second horizontal position in the vertical stack column for blocking a container above a dispensing container;

a biasing member connected to the separator to bias the separator member towards a first vertical position when the separator is in a first horizontal position and when the separator is in the second horizontal position, but allows the separator to move to a second, lower vertical position when the separator is in the second horizontal position.

2. The apparatus of claim 1 wherein the holder includes one or more walls that are adjustable to create different width vertical stack columns to accommodate different sized containers.

3. The apparatus of claim 1 further comprising a width adjustment component near the separator and connected to the holder to accommodate different sized containers.

4. The apparatus of claim 1 wherein the biasing member comprises a spring connected between the vertical stack column the dispensing device and the separator.

5. The apparatus of claim 4 wherein the spring is in tension when the separator is in the second, lower vertical position.

6. The apparatus of claim 1 further comprising a second biasing member connected to the separator to assist return of the separator to the first vertical position.

7. The apparatus of claim 6 wherein the second biasing member is a spring connected between the dispensing controller and the separator.

8. The apparatus of claim 7 wherein the spring of the second biasing member is in compression when the separator is in the second, lower vertical position.

9. The apparatus of claim 1 further comprising a stop member positioned on the actuator at or near the first vertical position for the separator to prevent movement of the separator above the location of the stop member.

10. The apparatus of claim 1 wherein the holder defines two vertical stack columns generally side by side.

11. The apparatus of claim 10 wherein the lower blocking member can block the end of one or both of the two vertical stack columns and the separator can block one of the vertical stack columns at a time.

12. An apparatus to resist breakage in a set of containers held in a vertical stack ready to be dispensed from a vending machine, the vending machine dispensing the containers by supporting a bottom-most container with a lower blocking member, removing the lower blocking member when the bottom-most container is approved to be dispensed and at the same time placing an upper blocking member underneath the next-to-bottom-most container to hold the remainder of the vertical stack, if any, in place, and after dispension of the bottom-most container, removing the upper blocking device, replacing the lower blocking member, and allowing the vertical stack, if any, to drop so that the next-to-bottom-most container assumes the position of bottom-most container, the improvement comprising:

a biasing component connected to the upper blocking member, the biasing component biasing the upper blocking member upward so that when the upper blocking component is not holding the stack, it is biased to an upper position and when the upper blocking member engages and then blocks any remainder of the vertical stack, allows the vertical stack to move against bias of the biasing component and move the upper blocking member downward by the weight of the remainder of the vertical stack, so that when the upper blocking member is removed, the remainder of the vertical stack, has a shorter distance to drop, and thus decreases the likelihood of any breakage or deformation of any container in the remainder of the vertical stack.

13. The apparatus of claim 12 wherein the biasing component comprises a spring, the spring compressing when the vertical stack moves against it.

14. The apparatus of claim 12 further comprising a second biasing component connected to the upper blocking member and biasing the upper blocking member to the upper position.

15. A method of reducing or deterring breakage in a vertical stack of containers dispensed at a lower end of the stack, wherein the vertical stack is held in position and dispension is achieved by gravity, comprising:

in a normal state supporting and blocking a bottom-most container of the stack from moving downward and being dispensed;

during the release of a bottom-most container in the stack for dispension, blocking the next-to-bottom-most container from dispension but allowing the stack to move downward a distance, reducing the distance the next-to-bottom-most container must fall to assume the position of bottom-most container after dispension of the bottom-most container.

16. The method of claim 15 wherein a biasing force is applied against the next-to-bottom-most container when the stack is allowed to move downward a distance.

17. The method of claim 16 wherein the biasing force is less than the force of several containers.

* * * * *

UNITED STATES PATENT AND TRADEMARK OFFICE

CERTIFICATE OF CORRECTION

PATENT NO. : 5,799,824
DATED : September 1, 1998
INVENTOR(S) : Joseph F. Gasiel

It is certified that error appears in the above-identified patent and that said Letters Patent is hereby corrected as shown below:

In claim 4, column 7, line 13, please delete [the dispensing device].

In claim 11, column 7, line 32, please delete [lower].

In claim 11, column 7, line 33, please insert --lower--.

Signed and Sealed this

Twenty-second Day of December, 1998

*Attest:*

*Attesting Officer*

BRUCE LEHMAN

*Commissioner of Patents and Trademarks*